US007425106B2

(12) United States Patent
Altmann et al.

(10) Patent No.: US 7,425,106 B2
(45) Date of Patent: Sep. 16, 2008

(54) CONCRETE PAVERS POSITIONED IN A HERRINGBONE PATTERN

(75) Inventors: Robert James Altmann, Lesueur, MN (US); Christopher Richard Ryan, Minneapolis, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 22 days.

(21) Appl. No.: 10/940,316

(22) Filed: Sep. 13, 2004

(65) Prior Publication Data

US 2006/0056912 A1 Mar. 16, 2006

(51) Int. Cl.
*E01C 5/06* (2006.01)

(52) U.S. Cl. ..... 404/39; 404/38; 404/17

(58) Field of Classification Search ..... 404/34, 404/37, 38, 41, 17; 52/603; D25/113
See application file for complete search history.

(56) References Cited

U.S. PATENT DOCUMENTS

| | | | | | |
|---|---|---|---|---|---|
| 382,683 | A | | 5/1888 | Bignell | |
| 421,618 | A | | 2/1890 | Schaeffer | |
| 862,012 | A | | 7/1907 | Perkins | |
| 952,918 | A | | 3/1910 | Mann | |
| 1,058,674 | A | | 4/1913 | Kertes | |
| 1,061,296 | A | | 5/1913 | Jennison | |
| 1,184,945 | A | | 5/1916 | Gilbert | |
| 1,302,560 | A | | 5/1919 | Jennison | |
| 1,340,896 | A | * | 5/1920 | Jennison | 404/38 |
| 1,364,236 | A | | 1/1921 | Bichan et al. | |
| 1,395,829 | A | | 11/1921 | Jennison | |
| 1,894,584 | A | * | 1/1933 | Fort | 52/391 |
| 2,060,746 | A | | 11/1936 | Porter | |
| 3,746,458 | A | | 7/1973 | Allocca | |
| 3,824,755 | A | | 7/1974 | Hartnell | |
| 4,016,692 | A | * | 4/1977 | Jordan et al. | 52/314 |
| 4,583,879 | A | | 4/1986 | Hofman | |
| 4,711,599 | A | * | 12/1987 | Glickman | 404/41 |
| 4,712,346 | A | | 12/1987 | Luitjen | |
| 4,846,601 | A | * | 7/1989 | Luijten | 404/73 |
| 5,186,574 | A | * | 2/1993 | Tavares | 404/73 |
| 5,201,843 | A | * | 4/1993 | Hair | 404/41 |

(Continued)

FOREIGN PATENT DOCUMENTS

DE 3641373 A1 6/1988

(Continued)

OTHER PUBLICATIONS

"Columbia Pavers Take Flight at the Hong Kong Airport," *Feed Drawer Magazine*, pp. 1-5 (Summer/Fall 1998).

(Continued)

*Primary Examiner*—Gary S Hartmann
(74) *Attorney, Agent, or Firm*—Merchant & Gould P.C.

(57) ABSTRACT

First and second concrete pavers that are configured to form a paver system arrangeable in a herringbone pattern. A plurality of the first pavers and a plurality of the second pavers, which together form a kit of pavers, can be used to construct a permeable pavement with the herringbone pattern. The first and second pavers are preferably molded in a layer with the pavers arranged in the herringbone pattern. The layer can then be mechanically installed using suitable mechanical installation equipment.

6 Claims, 5 Drawing Sheets

U.S. PATENT DOCUMENTS

| | | | | |
|---|---|---|---|---|
| 5,224,792 | A | 7/1993 | Hagenah | |
| 5,251,997 | A | 10/1993 | Brock | |
| 5,466,089 | A | 11/1995 | Jurik | |
| 5,496,129 | A | 3/1996 | Dubé | |
| 5,503,498 | A | 4/1996 | Scheiwiller | |
| 5,902,069 | A | 5/1999 | Barth et al. | |
| 6,015,243 | A | 1/2000 | Geiger | |
| 6,055,784 | A | 5/2000 | Geiger | |
| 6,073,411 | A * | 6/2000 | Ciccarello | 52/589.1 |
| D431,305 | S | 9/2000 | Barth et al. | |
| 6,168,347 | B1 * | 1/2001 | Milot et al. | 404/34 |
| D442,703 | S | 5/2001 | Fifield | |
| 6,263,633 | B1 | 7/2001 | Hagenah | |
| 6,536,988 | B2 | 3/2003 | Geiger | |
| 6,705,797 | B1 | 3/2004 | Wada | |
| 6,939,077 | B1 * | 9/2005 | Hart | 404/39 |
| 2003/0196399 | A1 | 10/2003 | Wu | |

FOREIGN PATENT DOCUMENTS

| | | | |
|---|---|---|---|
| EP | 0 636 755 | A1 | 2/1995 |
| GB | 2 233 009 | A | 1/1991 |
| GB | 2 247 702 | A | 3/1992 |

OTHER PUBLICATIONS

"Mechanical Installation of Interlocking Concrete Pavements," *ICPI Tech Spec*, No. 11, pp. 1-12 (2000).

"Port of Oakland Places Largest Concrete Paver Project in North America," *Interlocking Concrete Pavement Magazine*, vol. 8, No. 3, pp. 6-9 and 20 (Aug. 2001).

Smith, D., "Permeable Interlocking Concrete Pavements, Selection, Design Construction, Maintenance," *ICPI Interlocking Concrete Pavement Institute*, second edition, pp. 1-29 (2001).

"Tech Spec 15—A Guide for the Construction of Mechanically Installed Interlocking Concrete Pavements," *ICPI Tech Spec*, No. 15, pp. 1-12 (2003).

"The Ecological Stone System that's Kind to the Environment," http://www.westconpavers.com/sfrima_product_info.htm, 2 pages (2003).

"Glossary of Terms Used in the Production, Design, Construction and Testing of Interlocking Concrete Pavement," *ICPI Tech Spec*, No. 1, 6 pages (May 2001).

* cited by examiner

CONCRETE PAVERS POSITIONED IN A HERRINGBONE PATTERN

FIELD OF THE INVENTION

The invention relates to concrete pavers. More particularly, the invention relates to a concrete paver system that facilitates mechanical installation of the pavers in a herringbone pattern.

BACKGROUND OF THE INVENTION

Concrete pavers are high strength modular concrete units that fit together to create paved areas. Concrete pavers have been used for many years to construct paved areas for pedestrian and vehicular traffic. Concrete pavers have been used to pave walkways, driveways, streets, airport taxiways, parking lots, patios, and the like.

Many pavers are made with spacers on their sides to maintain a uniform spacing between the pavers. The spacers are designed to maintain a minimum joint width between the pavers that provides just enough space for sand to effectively fill the joints between the pavers. The sand between the pavers transfers shear loads between the pavers, thereby achieving vertical interlock of the pavers to prevent vertical movement of the pavers relative to one another. A common joint width for these types of pavers is about 1.5 mm.

The water permeability of the pavement can be increased, when desirable, by increasing the joint width. The Interlocking Concrete Pavement Institute, Tech Spec Number 1, May 2001 Revision (the "ICPI Tech Spec"), suggests that permeable pavement have joint widths of about 10 mm to about 30 mm. Accordingly, concrete pavers have been made with suitable spacer dimensions of this magnitude to create highly water permeable pavements.

In addition to water permeability, factors to be considered when installing pavers are the anticipated loading on the pavers and the aesthetics sought by the customer. Concrete pavers can be laid in a number of patterns to meet differing engineering requirements and aesthetic requirements. A popular pattern from both an aesthetic and engineering standpoint is a herringbone pattern. A herringbone pattern is visually appealing, and is the most effective pattern for dispersing forces from braking and accelerating vehicles, thereby maintaining horizontal interlock between the pavers. Herringbone patterns are usually installed with the lengths of the pavers at 45 degrees with respect to the anticipated direction of pedestrian or vehicular traffic, or they are laid in a 90 degree pattern as shown in FIG. 1.

Pavers are increasingly being installed using mechanical installation. In mechanical installation, machinery is used to lift and place layers of pavers that are prearranged in their final laying pattern. Mechanical installation increases the rate of paving, reduces worker fatigue, and reduces the risk of injury to workers.

SUMMARY OF THE INVENTION

The invention relates to a system of concrete pavers for use in creating a pavement, including permeable pavement, that has a herringbone pattern and that can be mechanically installed.

The system comprises first and second generally rectangular concrete pavers that are configured to form a pavement, and that are configured to be arranged in a herringbone pattern. A plurality of the first pavers and a plurality of the second pavers, which together comprise a kit of pavers, can be used to construct the pavement with the herringbone pattern.

The concrete pavers of the present invention are made in a dry cast process that is well-known in the art. The mold used to make these pavers is configured to make a plurality of both of the shapes of pavers, arranged in the herringbone pattern. Each "drop" of pavers so made is then stacked on a shipping pallet as a successive layer. A mechanical laying machine can take an entire layer of pavers from the shipping pallet, and can install the entire layer of pavers at one time.

Each of the first and second pavers has a top surface, a bottom surface, a generally vertical first side surface, a generally vertical second side surface opposite the first side surface, a generally vertical third side surface extending from the first side surface to the second side surface, and a generally vertical fourth side surface opposite the third side surface and extending from the first side surface to the second side surface. The first and second side surfaces have generally equal lengths and the third and fourth side surfaces have generally equal lengths. The length of the first and second side surfaces is greater than the length of the third and fourth side surfaces. The first and second pavers have generally the same length, width and height.

The first paver has at least two spacers on the first side thereof and at least one spacer on the third side thereof, with the spacers extending outward from the first and third side surfaces of the first paver generally the same distance. The first paver is free of spacers on the second and fourth side surfaces. In addition, a first of the spacers on the first side surface is positioned on one side of the midpoint of the length of the first side surface and a second of the spacers is positioned from the midpoint to the end of the side surface furthest from the first spacer.

The second paver has at least two spacers on the first side surface thereof and at least one spacer on the fourth side surface thereof, with the spacers extending outward from the first and fourth side surfaces of the second paver generally the same distance as the spacers on the first and third side surfaces of the first paver. The second paver is free of spacers on the second and third side surfaces. Further, a first of the spacers of the second paver on the first side surface thereof is positioned on one side of the midpoint of the length of the first side surface and a second of the spacers is positioned from the midpoint to the end of the side surface furthest from the first spacer.

In one embodiment, the first and second pavers are configured so as to create a permeable pavement when installed, with the first and second pavers having an overall width and length the same as that of an existing non-permeable paver. With the first and second pavers configured in this manner, the first and second pavers can be used on a job site to produce a permeable pavement and the non-permeable pavers can be used on the same job site to produce a non-permeable pavement. Due to the similarity in size of the pavers, the permeable and non-permeable pavements have generally similar appearances thereby providing general visual continuity between the different types of pavement. Further, due to their similarity in size, the first and second pavers can be used to replace individual non-permeable pavers in an existing non-permeable pavement. In this embodiment, the first and second pavers, together with the existing non-permeable pavers, form a complete paving system that allows formation of permeable and non-permeable pavement, each of which can be mechanically installed in a herringbone pattern, and with each pavement having a similar appearance.

DETAILED DESCRIPTION OF THE INVENTION

The invention provides a system of concrete pavers for use in creating a pavement having a herringbone pattern and that can be mechanically installed. The invention will be described with respect to the construction of a permeable pavement. However, the pavers can also be used to construct pavement that is not considered to be permeable pavement.

Figure 1:
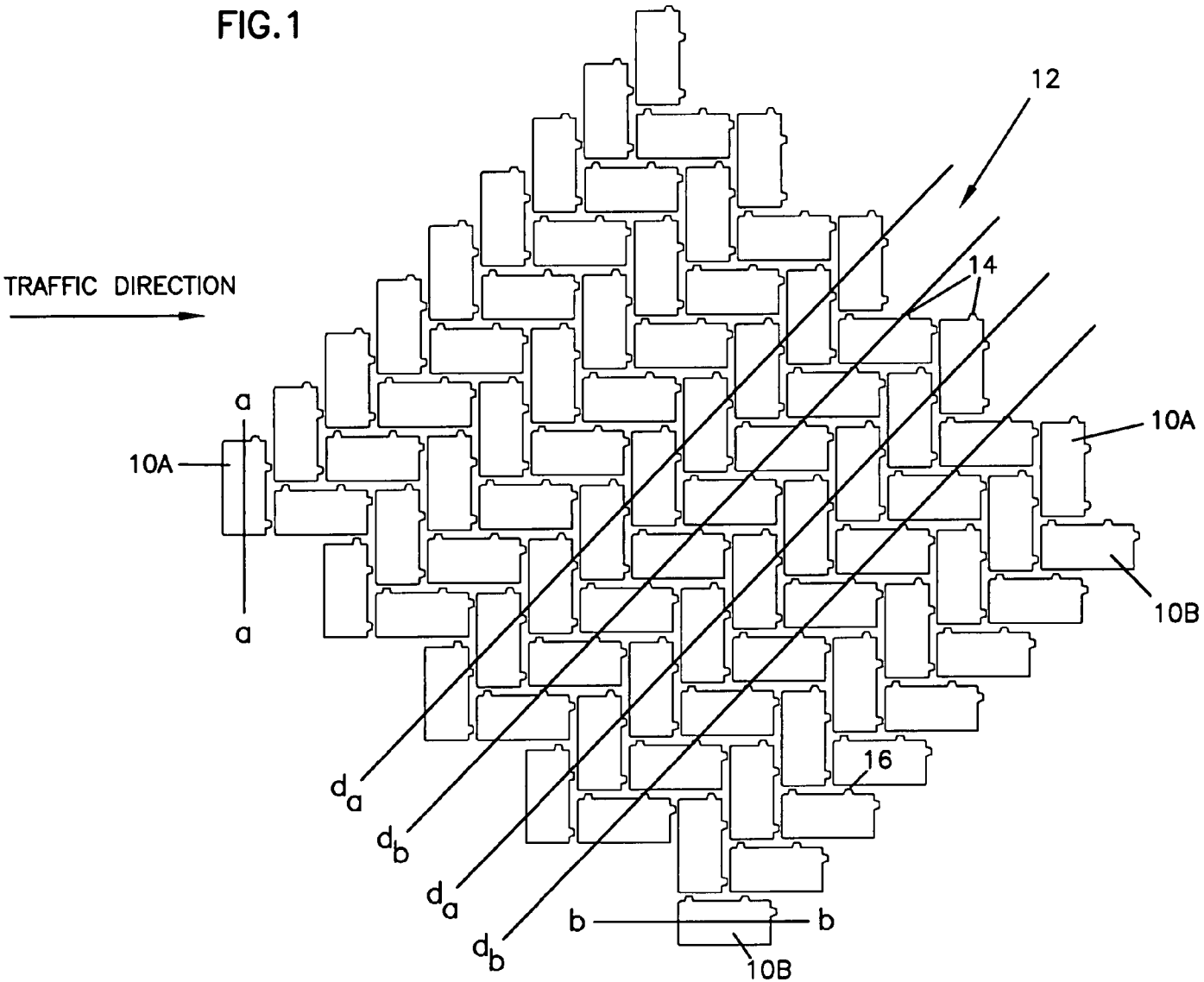
FIG. 1 illustrates a section of pavement formed from first and second pavers of the invention.

With reference initially to FIG. 1, the system comprises first and second concrete pavers 10A, 10B. A plurality of each of the pavers 10A, 10B are laid in a herringbone pattern to form a pavement 12.

The pavers 10A, 10B are spaced apart from one another by spacers 14 that are provided on the pavers to define joints 16 between the pavers. The joints are filled with a moisture permeable material, for example coarse aggregate or topsoil and grass. The joint width and the material filling the joints allow rainfall and other moisture to pass through the pavement 12, thereby increasing the drainage of rainfall and other moisture through the pavement 12. The pavement 12 is constructed on top of a suitable bedding course and base course, for example No. 8 aggregate and No. 57 aggregate, respectively.

The widths of the joints 16 are generally equal to each other. Preferably, the width of the joints 16 is less than or equal to about 15 mm. These joint widths, together with the material that fills the joints, provide a permeability that is similar to the permeability of conventional permeable pavers. However, other joint widths could be used depending upon how much water permeability is desired. FIG. 1 illustrates the pavers 10A, 10B as being spaced apart from each other with no contact between them. This is to better illustrate the concepts of the invention. It is to be realized that in actual use, the pavers 10A, 10B would be in contact with one another through the spacers 14.

Figure 3:
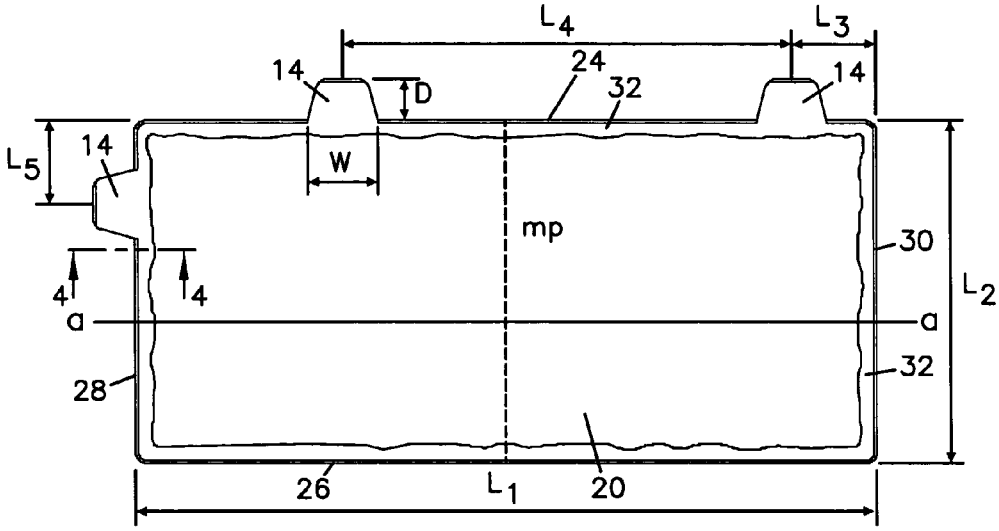
FIG. 3 is a top view of the first paver.
Figure 6:
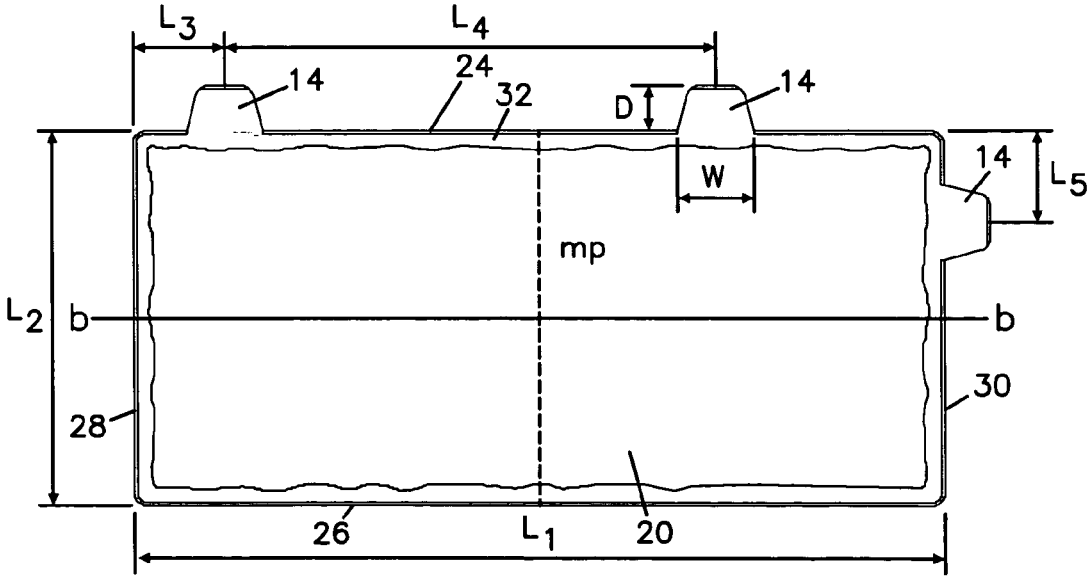
FIG. 6 is a top view of the second paver.

As shown in FIGS. 1, 3 and 6, each of the pavers 10A has a longitudinal axis a-a and each of the pavers 10B has a longitudinal axis b-b. The herringbone pattern in FIG. 1 is a 90 degree herringbone pattern where the longitudinal axes a-a are generally parallel to one another, the longitudinal axes b-b are generally parallel to one another, and the longitudinal axes a-a are generally perpendicular to the longitudinal axes b-b. In addition, the pavers 10A are arranged along a plurality of diagonal axes $d_a$ that are parallel to one another, and the pavers 10B are arranged along a plurality of diagonal axes $d_b$ that are parallel to one another and parallel to the axes $d_a$.

Details of the pavers 10A, 10B will now be described with reference to FIGS. 2-6. Each paver 10A, 10B is generally rectangular and made from dry cast concrete. The pavers are illustrated with generally rectilinear sides. However, the pavers could have one or more of the sides that deviate from rectilinear, for example opposite sides of the pavers could be serpentine, and still be considered generally rectangular.

Each paver 10A, 10B has a top surface 20 which during the intended use of the paver faces upward, a bottom surface 22 opposite the top surface 20 (the bottom surface of the paver 10B is not visible in the figures but is generally similar to the bottom surface of the paver 10A), a generally vertical first side surface 24 and a generally vertical second side surface 26 opposite the first side surface, a generally vertical third side surface 28 extending from the first side surface 24 to the second side surface 26, and a generally vertical fourth side surface 30 opposite the third side surface and extending from the first side surface to the second side surface.

A chamfer 32 is provided between the top surface 20 and the side surfaces 24, 26, 28, 30. The intersection between the chamfer 32 and the top surface 20 is preferably irregular, thereby making the top surface 20 appear irregular, to enhance the appearance of the pavers 10A, 10B.

For each paver 10A, 10B, the first and second side surfaces 24, 26 each have a length $L_1$ generally equal to each other, and the third and fourth side surfaces 28, 30 each have a length $L_2$ generally equal to each other. As shown in FIGS. 3 and 6, $L_1$ is greater than $L_2$. Preferably, $L_1$ is twice $L_2$. Further, the pavers 10A, 10B have generally equal length ($L_1$), width ($L_2$), and height (H) dimensions.

Figure 2:
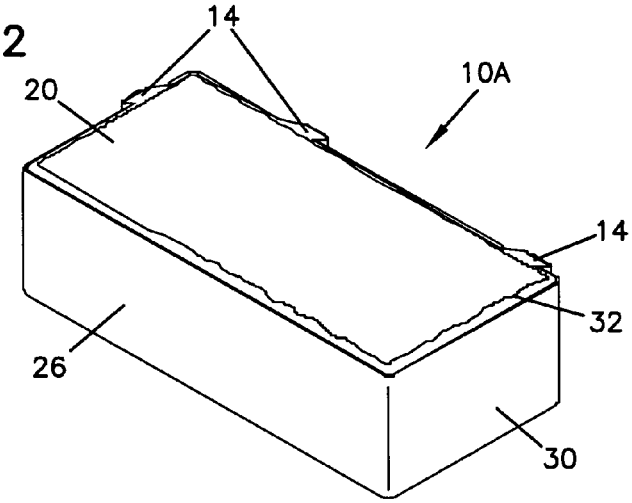
FIG. 2 is a perspective view of the first paver.
Figure 4:
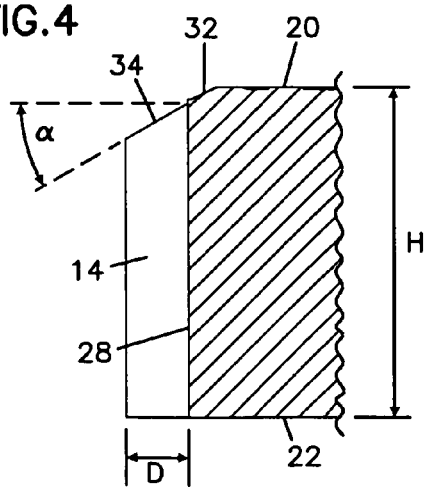
FIG. 4 is a cross-sectional view of a portion of the first paver taken along line 4-4 of FIG. 3.

Turning now to FIGS. 2-4, the paver 10A is integrally formed with at least two of the spacers 14 on the first side surface 24 and at least one of the spacers 14 on the third side surface 28. The spacers 14 extend outwardly from the respective side surface approximately the same distance D. The paver 10A is free of spacers on the second side surface 26 and on the fourth side surface 30, and those side surfaces 26, 30 are preferably generally planar. However, the side surfaces 26, 30, as well as the side surfaces 24, 28, could be provided with projections that extend outwardly therefrom a distance less than the distance D. In that case, those projections would not abut against adjacent pavers and would not function as spacers when the pavers are arranged in a herringbone pattern as described herein.

As best seen in FIG. 4, each spacer 14 extends nearly the entire height H of the paver 10A, from the bottom surface 22 to adjacent the top surface 20. The upper end of each spacer 14 near the top surface 20 has a chamfer 34 so that the top of the spacer 14 is disposed at an angle a to horizontal. This configuration helps to hide the spacers 14 when the pavers are laid and permeable material fills the joints 16.

Further, as best seen in FIG. 3, the spacers 14 are tapered whereby the spacers decrease in width W from the respective side surfaces 24, 28 to their free ends. Moreover, the spacers 14 on the side surface 24 are disposed on opposite sides of the midpoint mp of the length of the side surface 24, while the spacer 14 on the side surface 28 is disposed on one side of the longitudinal axis a-a. One spacer on the first side surface 24 is spaced a distance $L_3$ from the fourth side surface 30, and the spacers 14 on the first side surface 24 are spaced a distance $L_4$ from each other. The spacer 14 on the side surface 28 is spaced a distance $L_5$ from the first side surface 24.

Figure 5:
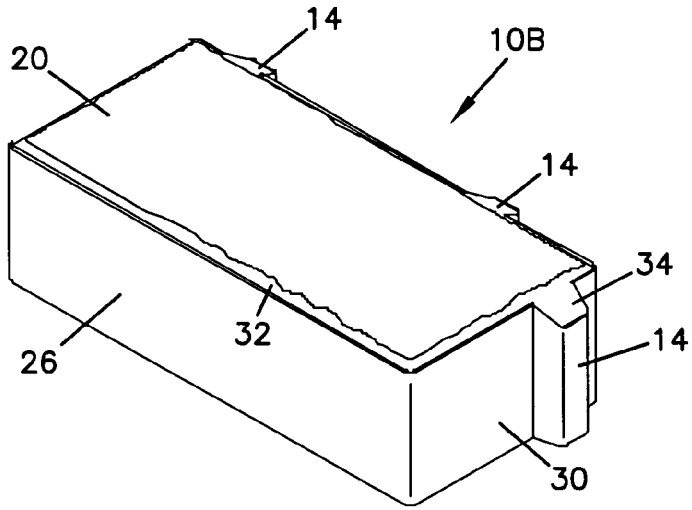
FIG. 5 is a perspective view of the second paver.

The paver 10B is generally similar to the paver 10A, but instead of having a spacer 14 on the third side surface 28, the paver 10B includes at least one spacer 14 on the fourth side surface 30, and the third side surface is free of spacers, as illustrated in FIGS. 5 and 6. Further, the positioning of the spacers 14 on the first side surface 24 of paver 10B is different than in paver 10A so that distance $L_3$ is now measured from the third side surface 28.

Exemplary dimensions for the pavers 10A, 10B are as follows:

| | Paver 10A | Paver 10B |
|---|---|---|
| $L_1$ | 264 mm | 264 mm |
| $L_2$ | 124 mm | 124 mm |
| H | 80 mm | 80 mm |
| $L_3$ | 30 mm | 30 mm |
| $L_4$ | 160 mm | 160 mm |
| $L_5$ | 30 mm | 30 mm |
| D | 15 mm | 15 mm |
| W | 25 mm | 25 mm |
| α | 30 degrees | 30 degrees |

These exemplary dimensions provide the pavers 10A, 10B with a face size (measured between the side surfaces 24, 26 and 28, 30) and overall widths and lengths (measured from the tip of spacer 14 on side surface 24 to the opposite side surface 26 and from the tip of spacer 14 on side surface 28 to the opposite side surface 30) that are the same as an existing non-permeable paver, the Holland paver by Anchor Block Company of Minnetonka, Minn. Pavers 10A, 10B having these exemplary dimensions can be used together with Holland pavers on a job site to produce permeable pavement (using the pavers 10A, 10B) and non-permeable pavement (using Holland pavers) as needed, with the permeable and non-permeable pavements having generally similar appearances thereby providing general visual continuity between the different types of pavement. Further, due to their similarity in size, individual pavers 10A, 10B having these exemplary dimensions can be used to replace individual Holland pavers in an existing pavement. This concept of making the overall widths and lengths of the pavers 10A, 10B the same as an existing non-permeable paver can be used with pavers other than Holland pavers.

Figure 7:
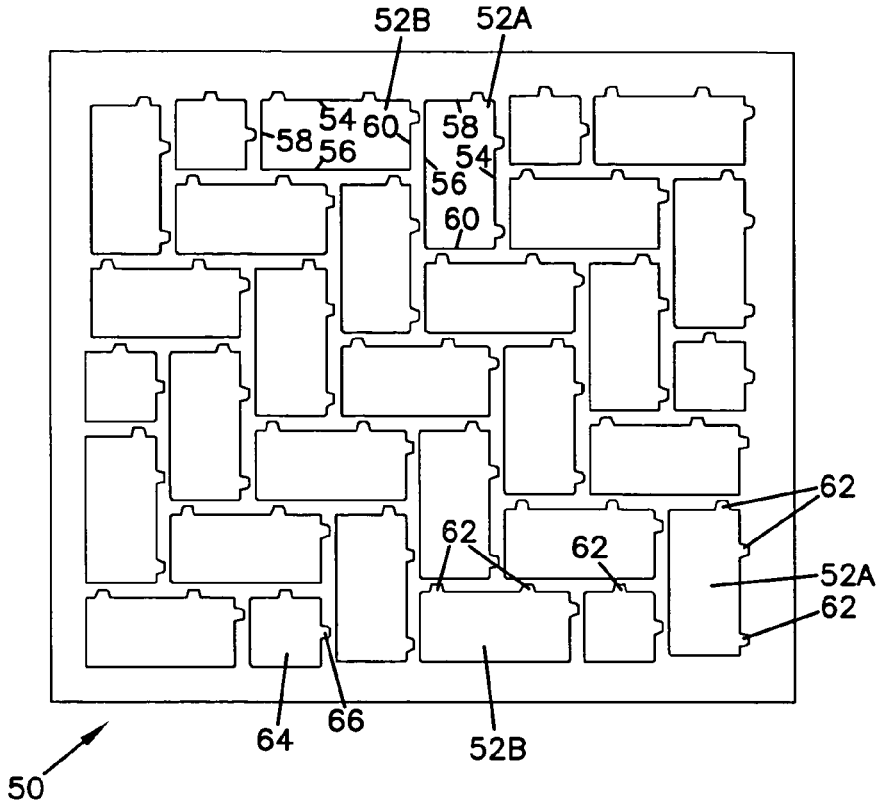
FIG. 7 is a top view of the mold showing the mold cavities used to form the first and second pavers of the invention into a layer of pavers, including half size square filler pavers to complete a rectangular layer of pavers.

With reference to FIG. 7, a mold 50 having a plurality of first and second mold cavities 52A, 52B suitable for forming the pavers 10A, 10B, respectively, is illustrated. The cavities 52A, 52B are arranged in a herringbone pattern so that the resulting pavers are molded in a herringbone pattern.

Each mold cavity 52A, 52B is generally rectangular, with first 54, second 56, third 58 and fourth 60 side faces, an open top and an open bottom. The side faces 54, 56, 58, 60 are generally vertical and have dimensions suitable for forming the side surfaces of the pavers 10A, 10B.

Each of the first cavities 52A has spacer cavities 62 formed in the side face 54 and in the side face 58 for forming the spacers 14 on the paver 10A. Similarly, each of the second cavities 52B has spacer cavities 62 formed in the side face 54 and in the side face 60 for forming the spacers 14 on the paver 10B. In the preferred embodiment, the side faces 56, 60 of the first cavities 52A and the side faces 56, 58 of the second cavities 52B are free of spacer cavities to form corresponding paver side surfaces that are planar and free of spacers.

Figure 9:
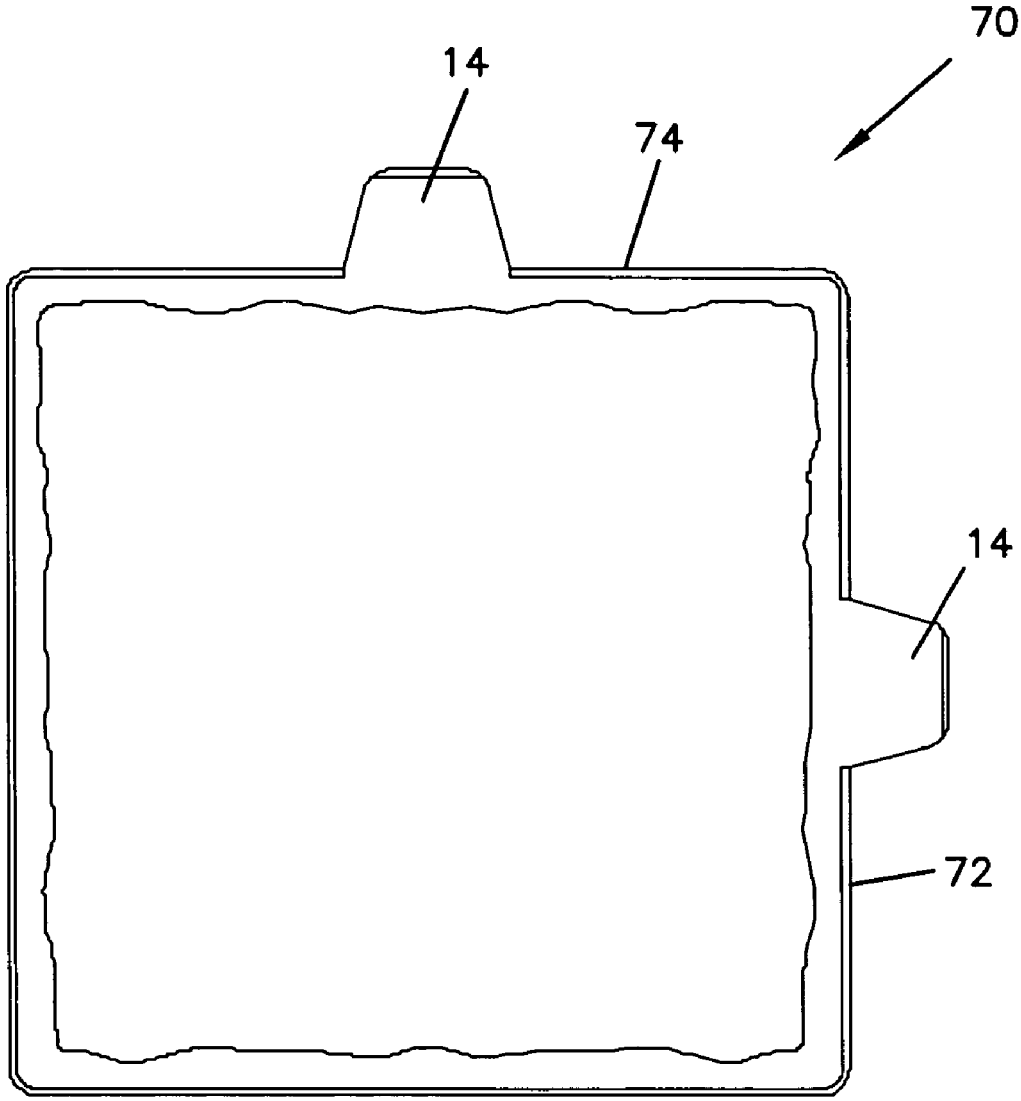
FIG. 9 is a top view of one of the half size square filler pavers produced by the mold of FIG. 7.

The mold 50 is also provided with generally square mold cavities 64 around the perimeter thereof to complete a generally rectangular paver layer mold. The mold cavities 64 fill in gaps between the cavities 52A, 52B that are present as a result of the herringbone arrangement of the cavities 52A, 52B. The cavities 64 are configured to produce a generally square paver 70, illustrated in FIG. 9, that is approximately half the size of the pavers 10A, 10B. Each cavity 64 is similar in construction to the cavities 52A, 52B, except for the square shape and the presence of only two spacer cavities 66, each of which is located approximately halfway along two adjacent sides of the cavity 64. The result is the paver 70 shown in FIG. 9, with spacers 14 halfway along adjacent sides 72, 74 of the paver 70.

To produce the pavers 10A, 10B, 70 the open bottoms of the mold cavities 52A, 52B, 64 are temporarily closed. In certain molding machines, closure can be achieved using a flat pallet that is brought into position underneath the mold 50. Once the bottoms are closed, dry cast concrete is introduced into the mold cavities through the open tops of the mold cavities. The concrete in each mold cavity is then consolidated through vibratory action and compaction that are well-known in the art. Such consolidation produces pre-cured concrete pavers. The bottoms of the mold cavities are then reopened, and the pre-cured concrete pavers are then discharged from the mold cavities through the reopened bottoms of the molds. Discharge can occur by lowering the pallet relative to the mold, with the stripper shoes pushing the pre-cured pavers out through the bottom. The pavers are then cured using known curing techniques.

Figure 8:
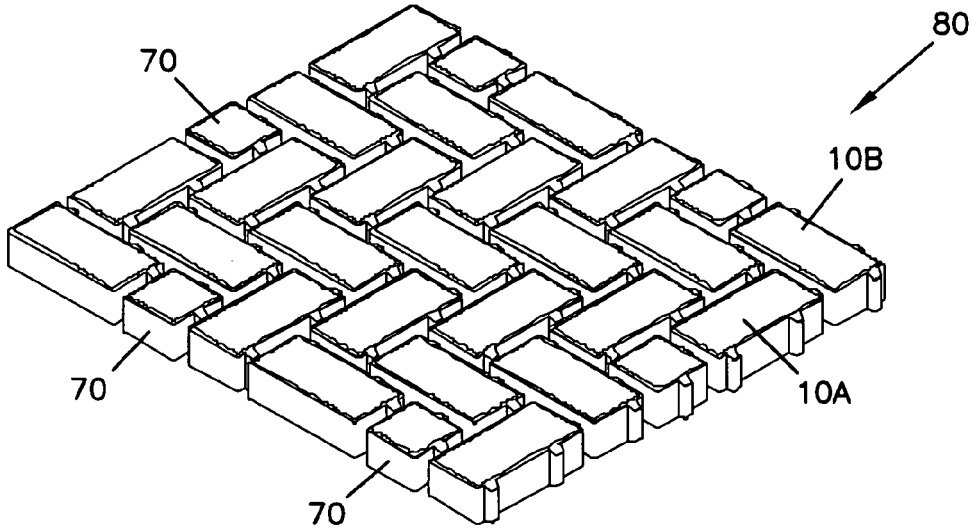
FIG. 8 is a perspective view of a rectangular layer of pavers produced by the mold of FIG. 7.

The result is a rectangular layer 80 of pavers 10A, 10B, 70, illustrated in FIG. 8, where the pavers 10A, 10B are molded in a herringbone pattern and the half pavers 70 fill in the sides of the rectangular paver layer. When a pavement is produced using a plurality of the layers 80, the layers 80 are preferably laid so that the pavers 70 in one layer are next to pavers 70 in an adjacent layer 80. The pavers 70 can then be removed by hand and replaced with one of the pavers 10A, 10B.

The entire layer 80 can be mechanically installed. The equipment used to install the layer 80 can be motorized or non-motorized. Further details on mechanical installation of concrete pavers and the function of such machinery are described in Interlocking Concrete Pavement Institute's Tech Spec Number 11, 2000 Revision.

The invention claimed is:

1. A layer of pavers suitable for mechanical installation; the layer comprising:

(a) a plurality of first, generally rectangular pavers; the first pavers each having: a top surface and an opposite bottom surface; a generally vertical first side surface; a generally vertical second side surface opposite the first side surface; a generally vertical third side surface extending from the first side surface to the second side surface; and a generally vertical fourth side surface opposite the third side surface and extending from the first side surface to the second side surface;

(i) the first and second side surfaces having generally equal lengths;

(ii) the third and fourth side surfaces having generally equal lengths;

(iii) the lengths of the first and second side surfaces being greater than the lengths of the third and fourth side surfaces; and, (iv) each first paver further having:

(A) at least first and second spacers on the first side surface thereof;

(1) each first paver having no chamfer between the bottom surface and the first side surface at least at the at least first and second spacers on the first side surface;

(2) each first paver having a chamfer between the top surface and the first side surface at least at the at least first and second spacers on the first side surface; and, (3) for each first paver, a first of the spacers on the first side surface being positioned on one side of a midpoint of the length of the first side surface; and a second of the spacers being positioned at a location between the midpoint and the end of the first side surface farthest from the first of the spacers on the first side surface;

(B) at least one spacer on the third side surface;

(1) each first paver having no chamfer between the bottom surface and the third side surface at least at the at least one spacer on the third side surface; and (2) each first paver having a chamfer between the top surface and the third side surface at least at the at least one spacer on the third side surface;

(C) the spacers on each first paver extending outward from the first and third surfaces generally the same distance;

(D) the first paver being free of spacers on the second and fourth side surfaces; and (E) each first paver being configured so that when positioned with the bottom surface directed down, the first side surface is a next side clockwise around the first paver from the third side surface;

(b) a plurality of second generally rectangular pavers; the second pavers each having: a top surface and an opposite bottom surface; a generally vertical first side surface; a generally vertical second side surface opposite the first side surface; a generally vertical third side surface extending from the first side surface to the second side surface; and a generally vertical fourth side surface opposite the third side surface and extending from the first side surface to the second side surface;

(i) the first and second side surfaces having generally equal lengths;

(ii) the third and fourth side surfaces having generally equal lengths;

(iii) the lengths of the first and second side surfaces being greater than the lengths of the third and fourth side surfaces; and (iv) each second paver further having:

(A) at least first and second spacers on the first side surface thereof;

(1) each second paver having no chamfer between the bottom surface and the first side surface at least at the at least first and second spacers on the first side surface;

(2) the first pavers each having a chamfer between the top surface and the first side surface at least at the at least first and second spacers on the first side surface; and (3) a first of the spacers on the first side surface being positioned on one side of a midpoint of the length of the first side surface; and a second of the spacers being positioned at a location between the midpoint and an the end of the first side surface farthest from the first of the spacers on the first side surface;

(B) at least one spacer on the fourth side surface;

(1) each second paver having no chamfer between the bottom surface and the fourth side surface at least at the at least one spacer on the fourth side surface; and (2) each second paver having a chamfer between the top surface and the fourth side surface at least at the at least one spacer on the fourth side surface;

(C) the spacers on each second paver extending outward from the second and fourth surfaces generally the same distance;

(D) the second pavers each being free of spacers on the first and third side surfaces; and (E) each second paver being configured so that when positioned with the bottom surface directed down, the first side surface is a next side located counterclockwise around the second paver from the fourth side surface;

(c) the first and second pavers each having generally the same length, width, and height; and (d) the first and second pavers being positioned in a herringbone pattern:

(i) with the bottom surfaces of each of the first and second pavers directed down;

(ii) with all first pavers oriented with the third side surface of each directed in a first direction;

(iii) with all second pavers oriented with a fourth side surface of each directed in a second direction; the second direction being generally perpendicular to the first direction; and (iv) with each two adjacent ones of the first and second pavers within the herringbone pattern having at least one spacer therebetween.

2. A layer of pavers according to claim 1 wherein:

(a) the third side surface of each first paver has one spacer thereon; and (b) the fourth side surface of each second paver has one spacer thereon.

3. A layer of pavers according to claim 1 wherein:

(a) the first side surface of each first paver has two spacers thereon; and (b) the first side surface of each second paver has two spacers thereon.

4. A layer of pavers according to claim 1 wherein:

(a) each spacer of each first paver and each spacer of each second paver extends from a side surface a distance of less than or equal to 15 mm.

5. A layer of pavers according to claim 4 wherein:

(a) the second side surface of each first paver has a length that is twice a length of each fourth side surface of each first paver; and (b) the second side surface of each second paver has a length that is twice a length of each third side surface of each second paver.

6. A layer of pavers according to claim 5 wherein:

(a) the layer includes a plurality of generally square pavers each positioned in selected edge spaces between selected first and second pavers, to fill in sides of the layer of pavers.

* * * * *

UNITED STATES PATENT AND TRADEMARK OFFICE

CERTIFICATE OF CORRECTION

PATENT NO. : 7,425,106 B2
APPLICATION NO. : 10/940316
DATED : September 16, 2008
INVENTOR(S) : Altmann et al.

It is certified that error appears in the above-identified patent and that said Letters Patent is hereby corrected as shown below:

Col. 4, line 49: "at an angle a to horizontal." should read --at an angle α to horizontal.--

Signed and Sealed this

Seventeenth Day of February, 2009

JOHN DOLL
*Acting Director of the United States Patent and Trademark Office*